US008292202B2

(12) United States Patent
Hirai

(10) Patent No.: US 8,292,202 B2
(45) Date of Patent: Oct. 23, 2012

(54) ELECTROSTATICALLY ATOMIZING DEVICE

(75) Inventor: Kouichi Hirai, Moriyama (JP)

(73) Assignee: Panasonic Corporation, Osaka (JP)

( * ) Notice: Subject to any disclaimer, the term of this patent is extended or adjusted under 35 U.S.C. 154(b) by 190 days.

(21) Appl. No.: 12/937,537

(22) PCT Filed: Apr. 16, 2009

(86) PCT No.: PCT/JP2009/001766

§ 371 (c)(1),
(2), (4) Date: Oct. 12, 2010

(87) PCT Pub. No.: WO2009/136470

PCT Pub. Date: Nov. 12, 2009

(65) Prior Publication Data

US 2011/0031335 A1 Feb. 10, 2011

(30) Foreign Application Priority Data

Apr. 18, 2008 (JP) ..... 2008-109439

(51) Int. Cl.
*B05B 5/16* (2006.01)
*B05B 5/025* (2006.01)
*B05B 5/00* (2006.01)

(52) U.S. Cl. ..... 239/690; 239/706

(58) Field of Classification Search ..... 239/3, 690, 239/704–707; 361/227, 228
See application file for complete search history.

(56) References Cited

U.S. PATENT DOCUMENTS

2006/0064892 A1* 3/2006 Matsui et al. ..... 34/96
2008/0130189 A1* 6/2008 Kobayashi et al. ..... 361/228
2009/0001200 A1 1/2009 Imahori et al.
2009/0121050 A1* 5/2009 Nakano et al. ..... 239/690
2009/0134248 A1* 5/2009 Yamaguchi ..... 239/690
2009/0179092 A1* 7/2009 Akisada et al. ..... 239/690
2009/0206185 A1* 8/2009 Akisada et al. ..... 239/690

FOREIGN PATENT DOCUMENTS

EP 1 733 797 A1 12/2006
EP 1 944 092 A1 7/2008
JP 2006-68711 A 3/2006
JP 2007-54808 A 3/2007
JP 2007-167758 A 7/2007
WO WO-2005/042171 A1 5/2005
WO WO-2007/010873 A1 1/2007
WO WO-2007/052583 A1 5/2007

OTHER PUBLICATIONS

International Search Report for the Application No. PCT/JP2009/001766 mailed Sep. 11, 2009.

* cited by examiner

*Primary Examiner* — Darren W Gorman
(74) *Attorney, Agent, or Firm* — Cheng Law Group, PLLC

(57) ABSTRACT

An electrostatically atomizing device in this invention comprises an emitter electrode, cooling means, and a high voltage source. The emitter electrode has a rode and a discharge head which is formed at one axial end of the rod. The cooling means is coupled in a heat transfer relation to one axial end of the rod away from the discharge head in order to cool the emitter electrode for condensation of water thereon from within a surrounding air. The high voltage source is configured to apply a high voltage to the emitter electrode for electrostatically atomizing the water on the discharge head. The emitter electrode includes a flange which is provided at a juncture between the discharge head and the rod to extend radially outwardly of the discharge head and the rod over an entire circumference of the discharge head. The discharge head is tapered to have an outwardly bulged side contour.

4 Claims, 6 Drawing Sheets

21
P
S
S1
21a
C
21e
21c
21b
L1

21
200
L2
T
W1
21a
21e
21c
21b
L1

21
L2
T
200
W1
21a
21e
21c
21b
W2

ELECTROSTATICALLY ATOMIZING DEVICE

TECHNICAL FIELD

This invention relates to an electrostatically atomizing device being configured to generate a mist of the charged minute water particles, and more particularly to an electrostatically atomizing device having a cooling means being configured to cool an emitter electrode in order to condense vapor in air around the emitter electrode into water which is electrostatically atomized by a high voltage.

BACKGROUND OF THE INVENTION

Japanese patent application publications No. 2007-54808A and No. 2006-68711A disclose conventional electrostatically atomizing devices. The conventional electrostatically atomizing device is provided for generating a mist of the charged minute water particles of nanometer sizes. The electrostatically atomizing device comprises an emitter electrode, a cooling means, and a high voltage source. The emitter electrode comprises a rod and a discharge head. The rod has one end holding the discharge head and has the other end thermally coupled to the cooling means. The cooling means is configured to cool the discharge head through the rod in order to condense vapor in air around the discharge head into water. Consequently, the water is condensed on the discharge head. The cooling means condenses the vapor in the air into a sufficient amount of the water onto the discharge head immediately after the cooling means is started. A sufficient amount of water supplied onto the discharge head is also a suitable amount of the water for generating the mist of the charged minute water particles by the electrostatically atomization. The high voltage source is configured to apply a high voltage to the emitter electrode in order to electrostatically atomize the water held by the discharge head.

When the cooling means cools the emitter electrode, the water is condensed on a surface of the discharge head. Subsequently, the high voltage source applies the high voltage to the discharge head through the rod, thereby the electrical field being generated between the emitter electrode and ground (earth). The electrical field moves the water on the surface of the discharge head to the tip of the discharge head. Then, the water at the tip of the discharge head is electrically charged by the electrical field. The electrically charged water receives a Coulomb force from electrical field generated between the emitter electrode and ground (earth). As a result, the electrically charged water is pulled along the direction of the electrical field, thereby the Taylor cone being formed at the water on the discharge head. And then, the Taylor cone keeps receiving the Coulomb force, Rayleigh Breakups are caused at the tip of the Taylor cone. According to the Rayleigh Breakups, the mist of the charged minute water particles of nanometer sizes is generated from the tip of the Taylor cone. In this way, the electrostatically atomizing device continuously generates the mist of the charged minute water particles of nanometer sizes without being supplied with the water by users. Therefore, the electrostatically atomizing device with above configurations has high usability.

However, because the cooling means cools the discharge head through the rod, the cooled rod also condenses the vapor in the air surrounding the rod into water on a surface of the rod. The water on the surface of the rod is moved by the electrical field toward the discharge head. Therefore, the discharge head is also supplied with the water from the rod. That is, the discharge head is supplied with excessive amount of the water. In the case where the excessive amount of the water is supplied to the discharge head, the Taylor cone having a shape which is suitable for electrostatically atomizing is not formed.

DISCLOSURE OF THE INVENTION

This invention is achieved to solve the above problem. The object in this invention is to provide an electrostatically atomizing device being configured to generate the mist of the charged minute water particles stably by forming the Taylor cone having a suitable form for electrostatically atomizing.

An electrostatically atomizing device in accordance with this invention comprises an emitter electrode, a cooling means, and a high voltage source. The emitter electrode has a rod and a discharge head which is formed at one axial end of the rod. The cooling means is coupled in a heat transfer relation to one axial end of the rod away from the discharge head in order to cool the emitter electrode for condensation of water thereon from within a surrounding air. The high voltage source is configured to apply a high voltage to the emitter electrode for electrostatically atomizing the water on the discharge head. A feature of this invention resides in that the emitter electrode further includes a flange which is provided at a juncture between the discharge head and the rod to extend radially outwardly of the discharge head and the rod over an entire circumference of the discharge head. The discharge head is tapered to have an outwardly bulged side contour.

In this case, the flange prevents the water condensed on a surface of the rod from moving to the discharge head. Therefore, a Taylor cone is formed by a suitable amount of water for electrostatically atomizing. In addition, the flange extends radially outwardly of the discharge head. The Taylor cone is formed from a circumference of the bottom of the discharge head toward a tip of the discharge head. That is, the Taylor cone is not formed from a circumference of the flange toward a tip of the discharge head. Therefore, it is possible to prevent the Taylor cone from combining with the water at the circumference of the flange.

It is more preferred that the discharge head has an apex, a bottom, and the bulged side contour. The bulged side contour is located outwardly of pseudo-cone or pseudo-pyramid having the apex and the bottom.

It is further preferred that the emitter electrode further include a needle electrode being disposed at a tip of the discharge head.

In this case, the electrostatically atomizing device is configured to generate a mist of the charged minute water particles with atomizing the water on the tip of the discharge head by applying the high voltage to the water on the discharge head. In addition, it is possible to generate a corona discharge in order to emit a negative ion by applying the high voltage to the tip of the needle electrode in a condition where the discharge head does not hold the water.

It is preferred that the electrostatically atomizing device further comprises a mode selector for selection between a first mode and a second mode. The mode selector in the first mode controls the high voltage source and the cooling means to electrostatically atomize the water on the discharge head. The mode selector in the second mode controls the high voltage source while deactivating the cooling means in order to apply a voltage to the emitter electrode for generating a corona discharge at the needle electrode.

In this case, it is possible to select either the first mode in order to generate the mist of the charged minute water particles or the second mode in order to emit the negative ion.

These and other features and advantages of the present invention will become more apparent from the following best mode for carrying out the present invention and embodiments.

BEST MODE FOR CARRYING OUT THE INVENTION

Now an electrostatically atomizing device in this invention is explained with using the attached drawings.

First Embodiment

Figure 1:
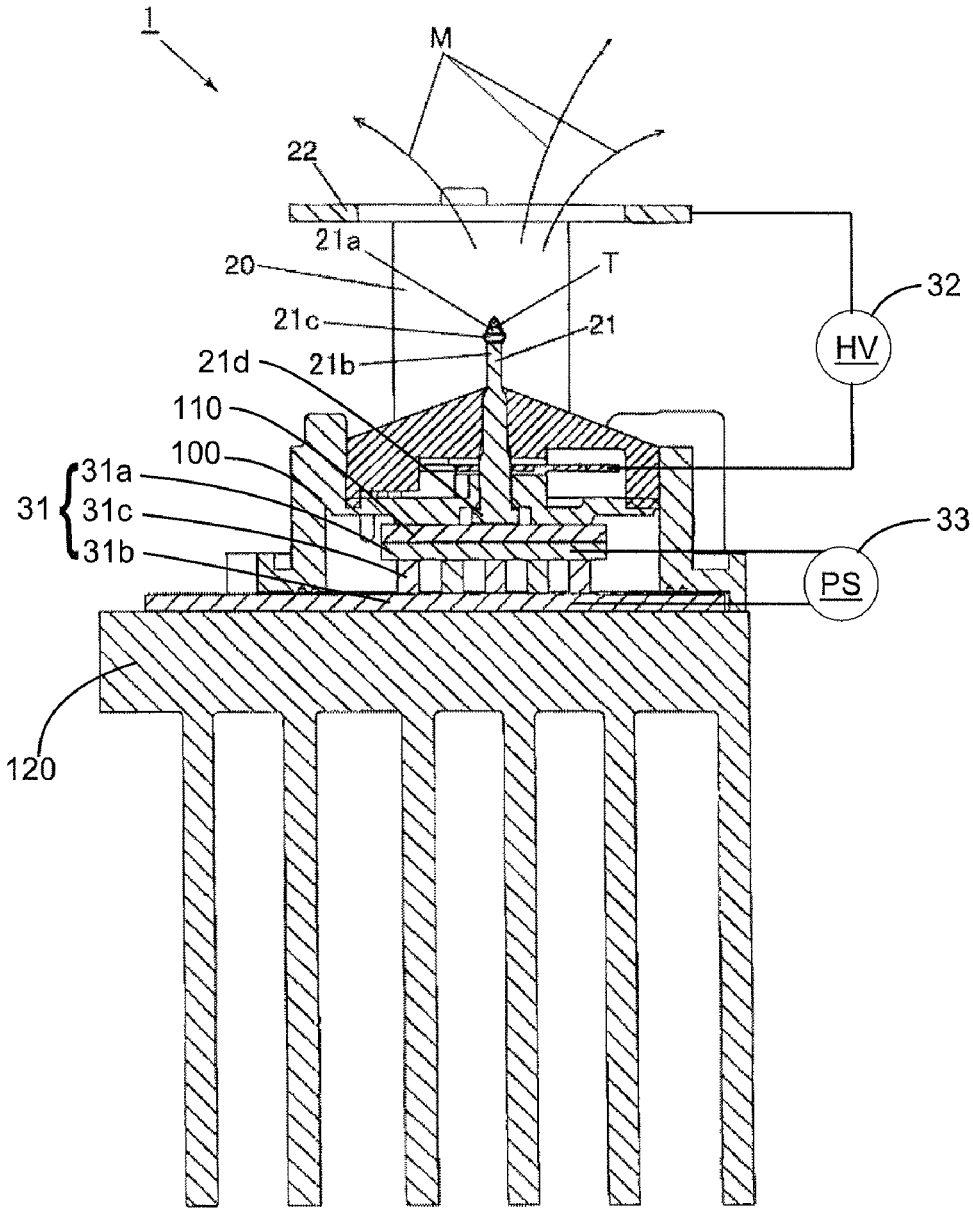
FIG. 1 shows a side cross sectional view of an electrostatically atomizing device in a first embodiment of this invention.

FIG. 1 shows a cross sectional view of the electrostatically atomizing device 1 in this invention. The electrostatically atomizing device 1 in this invention comprises an emitter electrode 21, an opposed electrode 22, a Peltier module 31, a high voltage source 32, a base 100, a holder 20, a cooling plate 110, and a heat radiating fin 120. The base 100 is configured to hold the emitter electrode 21, a Peltier module 31, and a heat radiating fin 120.

Figures 2A, 2B, 2C:
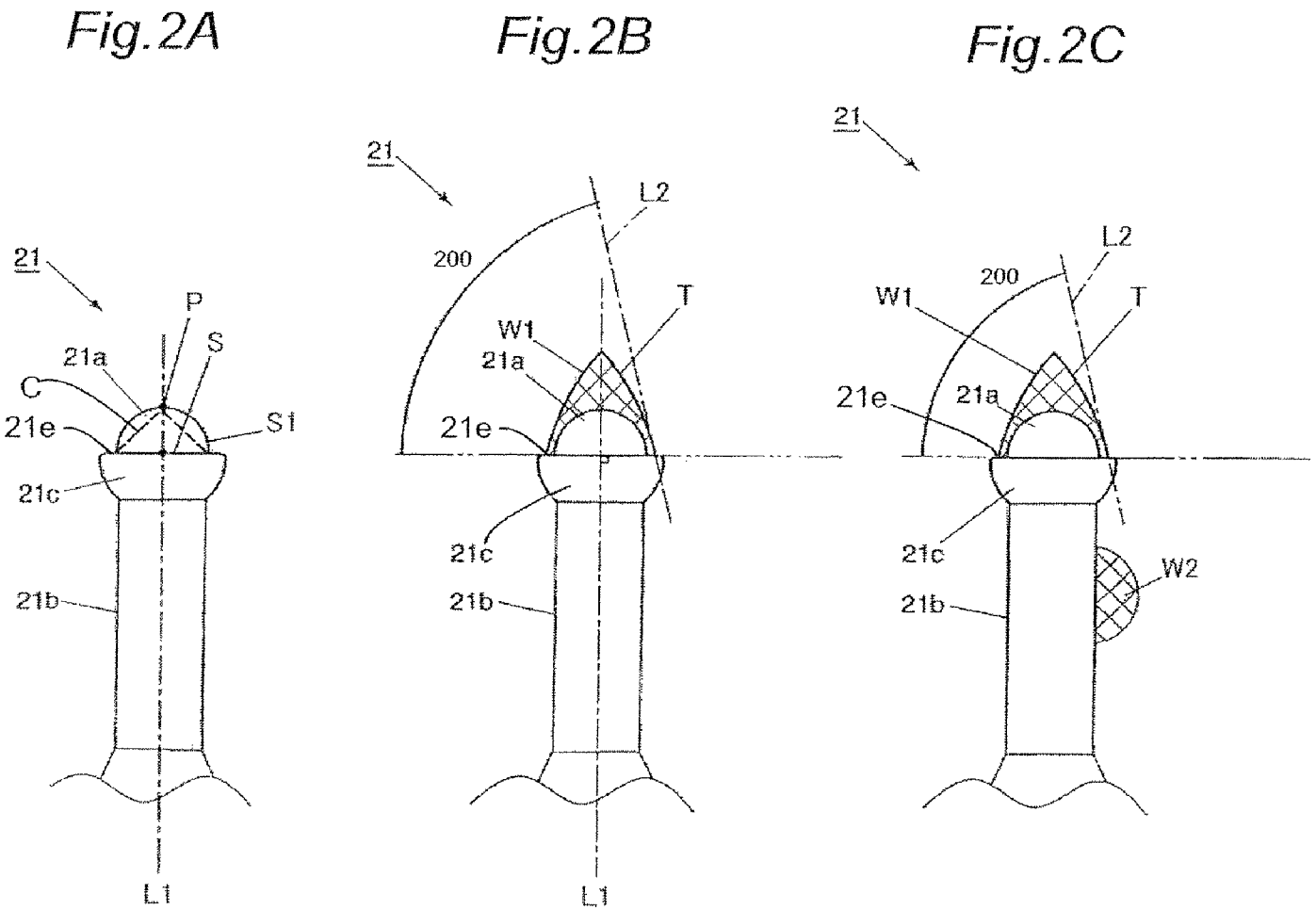
FIGS. 2A, 2B, and 2C show side views of an emitter electrode employed in the electrostatically atomizing device of the embodiment in this invention.

FIG. 2A shows the side view of the emitter electrode 21. As shown in FIG. 1 and FIG. 2A, the emitter electrode 21 has a rod 21*b*, a pedestal 21*d*, a discharge head 21*a*, and a flange 21*c*. The emitter electrode 21 is made of the electrical conductive material. The rod 21*b* has one end that an upper surface of the pedestal 21*d* is fixed, and has the other end holding the discharge head 21*a*. The pedestal 21*d* is held by the base 100, thereby the rod 21*b* being held by the base 100. The emitter electrode 21 has a juncture between the discharge head 21*a* and the rod 21*b*.

The flange 21*c* is provided at the juncture and extends radially outwardly of the discharge head 21*a* and the rod 21*b*. The flange 21*c* is formed to have a diameter perpendicular to an axis L1 of the rod 21*b*. The diameter of the flange 21*c* becomes larger from a lower end of the flange 21*c* toward the tip of the discharge head 21*a*, thereby the flange 21*c* having an upper end with a maximum diameter. The discharge head 21*a* has a maximum diameter perpendicular to the axis L1 of the rod 21*b*.

The discharge head 21*a* is formed to have a semi-sphere shape to have a bottom S. Therefore, the discharge head 21*a* has a pseudo-cone C, an outwardly bulged side contour S1, a tip P, and the bottom S. The tip P of the discharge head 21*a* is aligned with the axis L1 of the rod 21*b*. The pseudo-cone C has an apex which is defined by the tip P, and a bottom which is defined by the bottom S. Meanwhile, it is also possible to employ the discharge head 21*a* which has a pseudo-pyramid, the outward bulged side contour, the tip and the bottom. Consequently, the discharge head 21*a* is tapered from the bottom S toward the tip P of the discharge head 21*a* and has an outwardly bulged side contour S1. Diameter of the bottom S is defined as a maximum diameter of the discharge head 21*a* perpendicular to the axis L1 of the rod 21*b*.

The maximum diameter of the flange 21*c* is larger than the maximum diameter of the discharge head 21*a*. Therefore, an outermost circumference of the discharge head 21*a* is located inside of an outermost circumference of the flange 21*c*. Consequently, the outer surface of the discharge head 21*a* is spaced from the circumference of the top of the flange 21*c* so as to form an upper surface 21*e* of the flange 21*c*. The upper surface 21*e* is perpendicular to the axis L1 of the rod 21*b*.

The opposed electrode 22 is provided for electrostatically atomizing the water held on the discharge head 21*a* smoothly. The opposed electrode 22 is formed to have an annular shape with aperture. The holder 20 has one end holding the opposed electrode 22 and has the other end held by the base 100. Therefore, the opposed electrode 22 is disposed in an opposed relation to the emitter electrode 21.

The high voltage source 32 is configured to apply. a negative high voltage to emitter electrode 21 in order to generate an electrical field between the emitter electrode 21 and the opposed electrode 22.

The Peltier module 31 is defined as a cooling means which is configured to cool the emitter electrode 21 for condensation of water on the emitter electrode 21 from within a surrounding air. The Peltier module 31 includes a pair of electrically conductive circuit plates 31*a*, 31*b* and a plurality of thermoelectric conversion elements 31*c*. The conductive circuit plates 31*a*, 31*b* is made of electrical insulation material such as alumina and aluminum nitride. The thermoelectric conversion elements 31*c* are made of a thermoelectric conversion material such as Bi—Te based. A plurality of the thermoelectric conversion elements 31*c* are arranged in parallel between the electrical conductive circuit plate 31*a* and the electrical conductive circuit plate 31*b*. The electrical conductive circuit plates 31*a*, 31*b* receive the voltage by a power source 33. As a result the voltage is applied to the thermoelectric conversion elements 31*c*. The Peltier module 31 has the conductive circuit plate 31*a* as a cooling side and the conductive circuit plate 31*b* as a heat radiating side. The conductive circuit plate 31*a* is thermally coupled to the pedestal 21*d* of the electrical conductive circuit plate 31*a* through the cooling plate 110. Therefore, the Peltier module 31 is thermally coupled to the emitter electrode 21. When the electrical conductive circuit plate 31*a* is cooled, the emitter electrode 21 is cooled. That is, the Peltier module 31 is coupled in a heat transfer relation to the rod 21*b* through the pedestal 21*d*. On the other hand, the electrical conductive circuit plate 31*b* is coupled to the heat radiating fin 120. Therefore, heat of the electrical conductive circuit plate 31*b* is transferred toward the heat radiating fin 120 when the electrical conductive circuit plate 31*b* is heated. The heat of the heat radiating fin 120 is radiated to the air which surrounds the heat radiating fin 120.

This electrostatically atomizing device 1 generates the mist of the charged minute water particles M as follows. When a power button which is not shown in the figure is pressed, the high voltage source 32 and the power source 33 are started. Accordingly, the high voltage source 32 applies the voltage between the emitter electrode 21 and the opposed electrode 22, and the power source 33 applies the voltage to the thermoelectric conversion elements 31*c*. Then, the thermoelectric conversion elements 31*c* transfer the heat from the electrically conductive circuit plate 31*a* to the electrically conductive circuit plate 31*b*. Consequently, the electrically conductive circuit plate 31*a* is cooled by the thermoelectric conversion elements 31*c*. Because the conductive circuit plate 31*a* is thermally coupled to the cooling plate 110, the electrically conductive circuit plate 31*a* cools the discharge head 21*a* of the emitter electrode 21 through the cooling plate 110 and the rod 21*b*. The discharge head 21*a* condenses the vapor in the air into water W1 on its surface. In this way, the discharge head 21*a* is supplied with a suitable and a sufficient amount of the water W1 and holds the water W1 thereon. In addition, the discharge head is formed to have a semi-sphere configuration. Therefore, when the discharge head 21*a* condenses a vapor into a little amount of the water, a Taylor cone T is immediately formed at the discharge head 21*a*. That is, the Taylor cone T is formed by a little amount of the water because the discharge head 21*a* has the outwardly bulged side contour. In addition, because the discharge head 21*a* is tapered, the Taylor cone T having a suitable form for generating the mist of the charged minute water particles M is formed by a little amount of the water.

Since the high voltage source 32 applies the voltage between the emitter electrode 21 and the opposed electrode 22 as above mentioned, the high voltage source 32 generates the high voltage electrical field between the emitter electrode 21 and the opposed electrode 22. Due to the electrical field, the water on the discharge head 21*a* is electrically charged. Then, the high voltage electrical field generates Coulomb force. This Coulomb force acts on the electrically charged water on the discharge head 21*a* such that the Coulomb force pulls the water on the discharge head 21*a* toward the opposed electrode 22. In this way, the Coulomb force and surface tension of the water forms a Taylor cone T of the water on the discharge head 21*a*. Subsequently, due to the electrical field, the Taylor cone T of the water on the discharge head 21*a* is further electrically charged. Then, the high voltage electrical field generates a large Coulomb force. This large Coulomb force pulls the Taylor cone T of the water on the discharge head 21*a* toward the opposed electrode 22. In this way, the electrical field forms a large Taylor cone T of the water on the discharge head 21*a* shown in FIG. 2B. This Taylor cone T has a lateral surface which cooperates with the upper surface 21*e* to form a contact angle 200 which is smaller than 90 degrees.

When the Coulomb force becomes larger than the surface tension, breakups are caused at the tip of the Taylor cone T. The breakup is so-called Rayleigh Breakup. And finally, according to the Rayleigh breakups which are caused at the tip of the Taylor cone T, the mist of the charged minute water particles M of nanometer sizes are generated from the Taylor cone T on the discharge head 21*a*. The mist of the charged minute water particles M of nanometer sizes is flown through the aperture of the opposed electrode 22.

At this moment, when the discharge head 21*a* is cooled by the Peltier module 31, the rod 21*b* is also cooled by the Peltier module 31. Therefore, the rod 21*b* condenses the vapor within surrounding the air into water on the surface of the rod 21*b*. According to the condensation of the water by the rod 21*b*, a droplet W2 is generated on the surface of the rod 21*b*. The droplet on the surface of the rod 21*b* is electrically charged by the electrical field between the emitter electrode 21 and the opposed electrode 22. Therefore, the electrical field generates the Coulomb force which pulls the droplet W2 toward the discharge head 21*a*. However, the flange 21*c* prevents the droplet W2 at the rod 21*b* from moving toward the discharge head 21*a*. Therefore, only the discharge head 21*a* condenses the vapor into the water thereon, thereby discharge head 21*a* holding a suitable and a sufficient amount of the water for electrostatically atomizing. That is, the flange 21*c* makes it possible for discharge head 21*a* to hold a suitable and a sufficient amount of the water for electrostatically atomizing.

As above mentioned, this electrostatically atomizing device 1 in this embodiment comprises the emitter electrode 21 which has the flange 21*c* which is provided at the juncture between the discharge head 21*a* and the rod 21*b*. This flange 21*c* prevents the water on the surface of the rod 21*b* from moving to the discharge head 21*a*. Therefore, the discharge head 21*a* is supplied with a suitable and sufficient amount of the water by the Peltier module which cools the discharge head 21*a* through the rod 21*b*. On the other hand, the emitter electrode 21 is provided with the flange so as not to supply the water to the discharge head 21*a* from the rod 21*b*. Therefore, the discharge head 21*a* is not supplied with excess water from the rod 21*b*. Consequently, it is possible to form the Taylor cone T having a suitable form for generating the mist of the charged minute water particles M of nanometer sizes.

In addition, when the discharge head 21*a* is cooled by the Peltier module 31, the discharge head 21*a* condenses the vapor within surrounding the air into water. The discharge head 21*a* holds not much water at the beginning of the condensation of the water. However, the discharge head 21*a* in this embodiment has the semi-sphere shape. Therefore, it is possible to form the Taylor cone T at the discharge head 21 a with a little amount of the water. Therefore, the mist of the charged minute water particles M is immediately generated after the power source 33 is started.

Furthermore, the discharge head 21*a* in this embodiment has the semi-sphere shape. That is, the discharge head 21*a* is tapered to have an outwardly bulged side contour. Therefore, when the discharge head 21*a* is supplied with the water, the Coulomb force and the surface tension of the water forms the Taylor cone T. The discharge head 21*a* supports the Taylor cone T to have the suitable form for electrostatically atomizing. Therefore, it is possible to stably generate the mist of the charged minute water particles M from the Taylor cone T.

Figure 4:
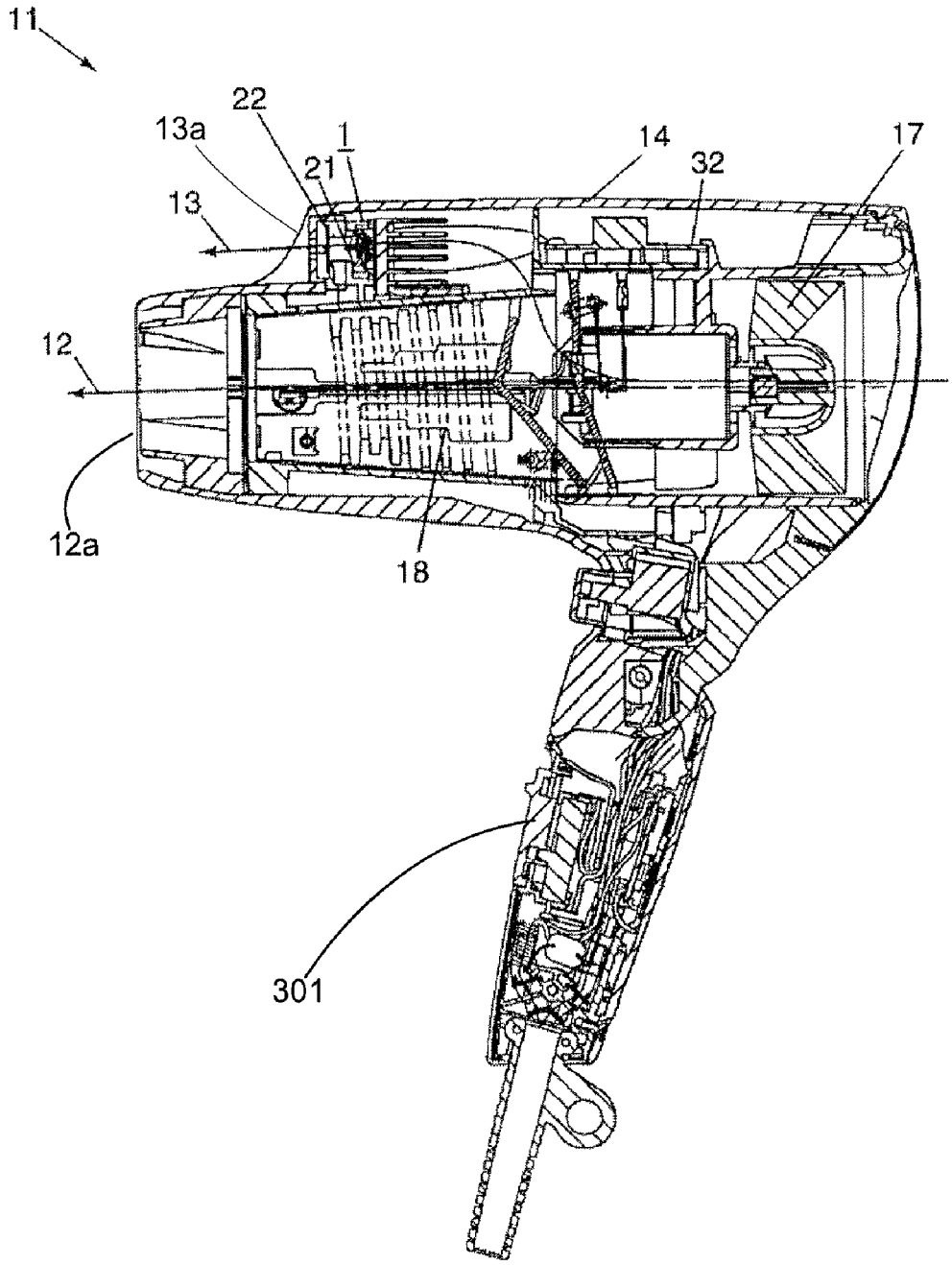
FIG. 4 shows a side cross sectional view of the hair dryer that the electrostatically atomizing device in this invention is incorporated.

This electrostatically atomizing device 1 is incorporated into a hair care device such as a drier 11. FIG. 4 shows a cross sectional view of the drier 11 with the electrostatically atomizing device 1. This drier comprises a casing 14, a fan 17, a heater 18, and the electrostatically atomizing device 1. The casing is formed to have its inside with an air flow path 12 and a branch air flow path 13. The fan 17 is disposed at an inside of the casing to generate an air flow which flows through the air flow path 12 so as to blow the air from an opening 12*a* of the casing 14. Furthermore, the fan 17 is disposed at an inside of the casing 14 to generate a branch air flow which flows through the branch air flow path 13 so as to blow the air through a second opening 13*a*. The heater 18 is disposed between the opening 12*a* and the fan 17 in order to heat the air which flows through the air flow path 12. The electrostatically atomizing device 1 is disposed in the casing 14 so as to be located at the branch air flow path 13.

When the drier 11 is started, the drier blows a hot air or air at ordinary temperatures from the opening 12*a*. In addition, when the drier 11 is started, the electrostatically atomizing device 1 generates the mist of the charged minute water particles M. This mist is carried from the drier through the second opening 13*a* by the branch air flow. Consequently, the drier 11 is configured to blow the hot air or air at ordinary temperature and the mist of the charged minute water particles M to the user.

Figure 3A:
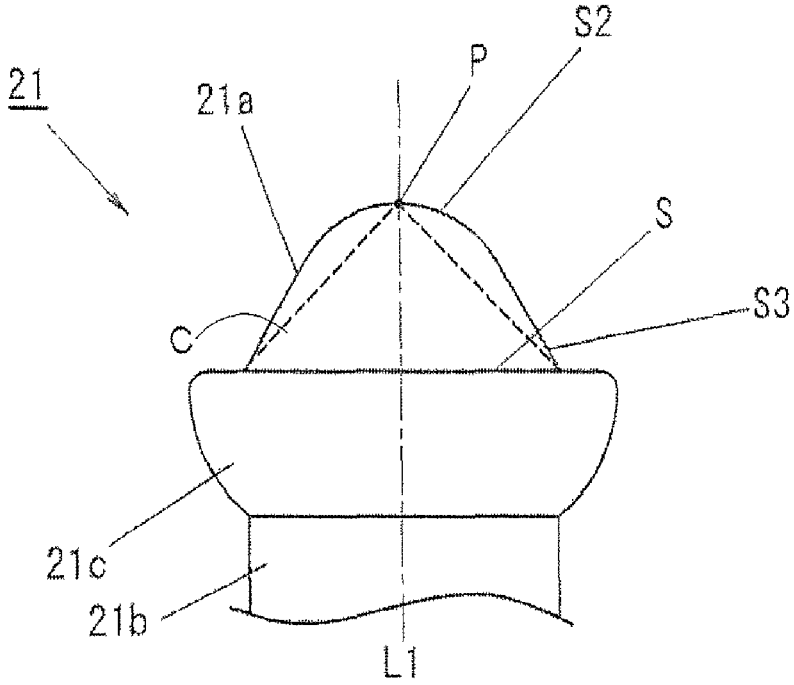
FIGS. 3A and 3B show side view of a modified emitter electrode in this invention.
Figure 3B:
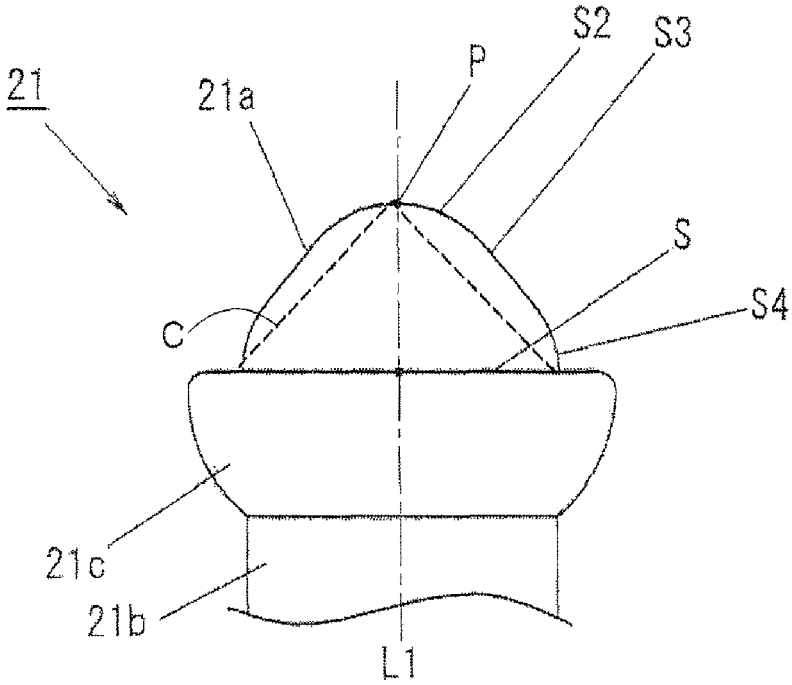

In addition, it is not limited to discharge head 21*a* having a semi-sphere shape. FIG. 3 shows a first modification of the emitter electrode in this embodiment. The discharge head 21*a* in FIG. 3A and FIG. 3B are also have a pseudo-cone C, a outwardly bulged side contours S2, S3, S4, a bottom S and a tip P. That is, the discharge head 21*a* in FIG. 3A and FIG. 3B are also tapered to have a lateral surface which is outwardly bulged. Therefore, the discharge head 21 a in FIG. 3A is tapered to have the outwardly bulged side contours S2 and S3. The discharge head 21*a* in FIG. 3B is tapered to have outwardly bulged side contours S2, S3 and S4. In each of the modifications, it is possible to stably generate the mist of the charged minute water particles M from the Taylor cone T.

Figure 5:
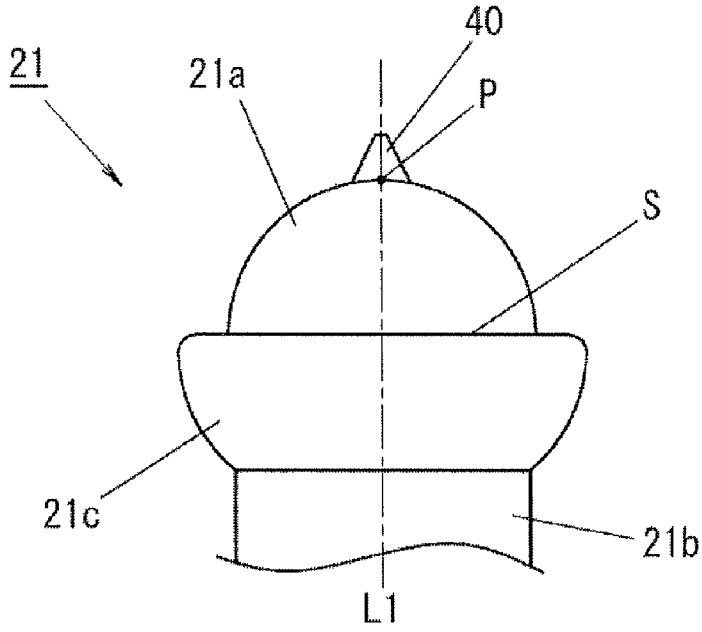
FIG. 5 shows a side view of the emitter electrode with a needle electrode in this invention.

FIG. 5 shows a second modification of the emitter electrode 21 in this embodiment. In this modification, the emitter electrode 21 further comprises a needle electrode 40 having a tip which is aligned with the axis L1 of the rod 21*b*. As shown in FIG. 5, the needle electrode 40 is formed to have a circular truncated cone. The needle electrode 40 is provided at the tip of the discharge head 21*a* and extends along the axis L1 of the rod 21*b*. The needle electrode 40 is integrally formed with the discharge head 21*a*.

The electrostatically atomizing device 1 with this configuration is configured to generate the corona discharge at the tip of the needle electrode 40 when the high voltage source 32 applies the high voltage between the opposed electrode 22 and the emitter electrode 21 without the water on the discharge head 21*a*. The corona discharge negatively charges oxygen of the air which surrounds the emitter electrode 21. The negatively charged oxygen is coupled to minute water in the air. As a result, the negative ion is discharged from the electrostatically atomizing device 1. It is preferred that the electrostatically atomizing device 1 in this modification is assembled to the hair care device such as the drier as above mentioned. In the case where the electrostatically atomizing device 1 in this modification is incorporated into the drier 11 shown in FIG. 4, the drier 11 is configured to generate the mist of the charged minute water particles M and is configured to generate the corona discharge. In addition, the needle electrode 40 has a function to form the Taylor cone T having the suitable form for electrostatically atomizing.

Second Embodiment

Figure 6:
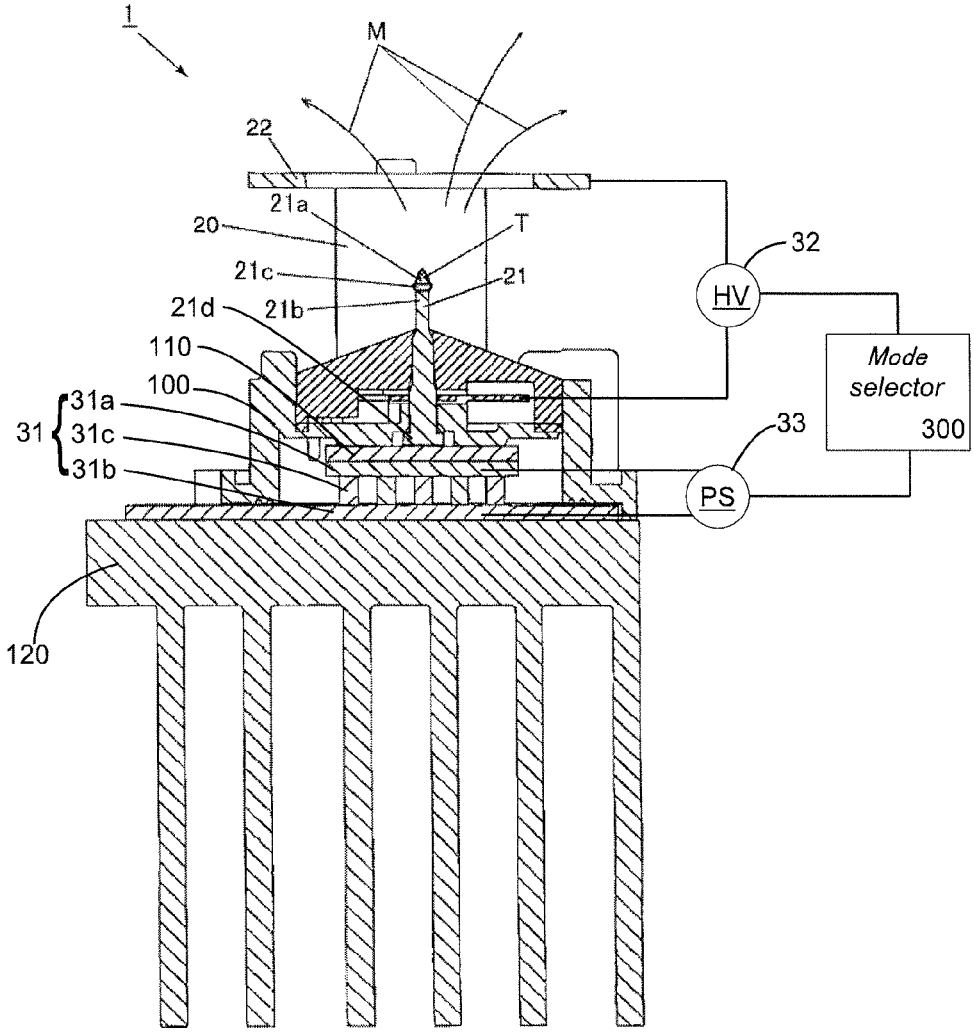
FIG. 6 shows a side cross sectional view of an electrostatically atomizing device in a second embodiment of this invention

FIG. 6 shows a second embodiment of the electrostatically atomizing device 1 in this invention. The electrostatically atomizing device 1 of this embodiment comprises almost the same elements shown in the first embodiment excepting features shown in this embodiment. Therefore, the elements same as the first embodiment are not explained in this embodiment. In addition, the elements same as the first embodiment are shown by the same numerals.

The electrostatically atomizing device 1 in this embodiment comprises the emitter electrode 21, the opposed electrode 22, the Peltier module 31, the high voltage source 32, the base 100, the holder 20, the cooling plate 110, the heat radiating fin 120, the power source 33, and a mode selector 300.

The emitter electrode 21 in this embodiment is same as the emitter electrode 21 in the second modification of the first embodiment. That is, FIG. 2A also shows the tip of the emitter electrode 21 in this embodiment.

The power source 33 is configured to apply voltage between the electrical conductive plates 31*a* and 31*b* in order to apply the voltage between the thermoelectric conversion elements 31*c*.

The mode selector 300 is provided for selection between a first mode and a second mode such that the electrostatically atomizing device 1 is operated with the first mode or with the second mode. In the first mode, the power source 33 is operated in order to condense the vapor into water on the discharge head 21*a*, and the high voltage source 32 is operated in order to electrostatically atomizing the water on the discharge head 21*a*. Consequently, the electrostatically atomizing device 1 generates the mist of the charged minute water particles M. On the other hand, in the second mode, the power source 33 is not operated and the high voltage source 32 is operated in order to apply the voltage between the emitter electrode 21 and the opposed electrode 22. Therefore, the Peltier module is deactivated. Consequently, the electrostatically atomizing device 1 generates the corona discharge at the needle electrode 40.

With this configuration, the electrostatically atomizing device 1 in this embodiment is configured to be operated with the first mode of operating the high voltage source 32 and the Peltier module 31 in order to atomize the water on the discharge head. In addition, the electrostatically atomizing device 1 in this embodiment is configured to be operated with the second mode of operating the high voltage source 32 and deactivating the Peltier module in order to generate the corona discharge at the needle electrode 40. Furthermore, the selector makes it possible for the electrostatically atomizing device 1 to selectively generate the mist of the charged minute water particles M at the discharge head 21*a* or the corona discharge at the needle electrode 40.

The electrostatically atomizing device 1 in this embodiment is incorporated into the hair care device such as the drier 11 shown in FIG. 4. The drier 11 is provided with a selecting switch 301 for selecting an operation mode of the electrostatically atomizing device 1. The mode selector 300 is configured to select between the first mode and the second mode according to the selection of the selecting switch 301. Consequently, the user is able to use the drier 11 with the first mode or with the second mode. In this way, the drier 11 is configured to generate the mist of the charged minute water particles M or is configured to generate the corona discharge selectively.

The invention claimed is:

1. An electrostatically atomizing device comprising:

an emitter electrode having a rod and a discharge head formed at one axial end of said rod;

cooling means coupled in a heat transfer relation to one axial end of said rod away from said discharge head in order to cool said emitter electrode for condensation of water thereon from within a surrounding air; and a high voltage source configured to apply a high voltage to said emitter electrode for electrostatically atomizing the water on said discharge head;

wherein said emitter electrode includes a flange which is provided at a juncture between said discharge head and the rod to extend radially outwardly of said discharge head and said rod over an entire circumference of said discharge head, said discharge head being tapered to have an outwardly bulged side contour.

2. An electrostatically atomizing device as set forth in claim 1, wherein said discharge head has an apex, a bottom, and said bulged side contour, said bulged side contour being located outwardly of a pseudo cone or pseudo pyramid having said apex and said bottom.

3. An electrostatically atomizing device as set forth in claim 1, wherein said emitter electrode further includes a needle electrode being disposed at a tip of the discharge head.

4. An electrostatically atomizing device as set forth in claim 3, wherein said electrostatically atomizing device further comprises a mode selector for selection between a first mode of controlling said high voltage source and said cooling means to electrostatically atomize the water on said discharge head, and a second mode of controlling said high voltage source while deactivating said cooling means in order to apply a voltage to said emitter electrode for generating a corona discharge at said needle electrode.

* * * * *